US009581954B2

(12) United States Patent
Thayer et al.

(10) Patent No.: US 9,581,954 B2
(45) Date of Patent: Feb. 28, 2017

(54) SYSTEM AND METHOD FOR CLEANING AN IMAGE RECEIVING SURFACE IN AN INKJET PRINTER

(71) Applicant: Xerox Corporation, Norwalk, CT (US)

(72) Inventors: Bruce E. Thayer, Spencerport, NY (US); Lawrence Floyd, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/638,239

(22) Filed: Mar. 4, 2015

(65) Prior Publication Data

US 2016/0257147 A1 Sep. 8, 2016

(51) Int. Cl.

| | |
|---|---|
| ***G03G 21/00*** | (2006.01) |
| ***G03G 15/16*** | (2006.01) |
| ***B41J 29/17*** | (2006.01) |
| ***B41J 2/165*** | (2006.01) |

(52) U.S. Cl.

CPC ..... *G03G 21/0058* (2013.01); *B41J 2/16535* (2013.01); *B41J 29/17* (2013.01); *G03G 15/161* (2013.01); *G03G 15/168* (2013.01); *G03G 21/007* (2013.01)

(58) Field of Classification Search

CPC . B41J 29/00; G03G 21/0011; G03G 21/0035; G03G 21/007

See application file for complete search history.

(56) References Cited

U.S. PATENT DOCUMENTS

| | | | | |
|---|---|---|---|---|
| 3,468,248 | A | 9/1969 | Giori | |
| 2003/0156868 | A1 | 8/2003 | Shin et al. | |
| 2005/0034621 | A1* | 2/2005 | McNeil | B41M 1/00 101/483 |
| 2007/0212128 | A1* | 9/2007 | Asakura | G03G 15/169 399/307 |
| 2009/0317555 | A1* | 12/2009 | Hori | B41J 2/0057 427/428.06 |
| 2010/0251916 | A1 | 10/2010 | Peles et al. | |

(Continued)

FOREIGN PATENT DOCUMENTS

| | | |
|---|---|---|
| EP | 2 075 648 A2 | 7/2009 |
| EP | 2 281 691 A1 | 2/2011 |

(Continued)

*Primary Examiner* — Kristal Feggins
*Assistant Examiner* — Kendrick Liu
(74) *Attorney, Agent, or Firm* — Maginot Moore & Beck LLP

(57) ABSTRACT

A printer cleaning device cleans an image receiving surface with a surface preparation material, includes a roller having a perforated cylindrical wall surrounded by a foam material. The cylindrical wall has an interior volume for holding a fluid pumped into the interior volume by a pump. The pressurized fluid flows through the cylindrical wall into the foam material as the roller is moved into engagement with the image receiving surface. The roller is rotated in a direction opposition to a direction of movement of the image receiving surface to help the foam material to scrub the image receiving surface and apply the fluid to the surface. As the roller is moved away from the surface, the foam material expands to facilitate absorption of fluid and remove material from the image receiving surface. The foam material in one embodiment is hydrophobic.

16 Claims, 6 Drawing Sheets

(56) References Cited

U.S. PATENT DOCUMENTS

2012/0256979 A1* 10/2012 Gordon ..... B41J 2/17593
347/5

FOREIGN PATENT DOCUMENTS

| | | | | | |
|---|---|---|---|---|---|
| GB | 1244901 | A | * | 9/1971 | ..... G03G 21/0088 |
| JP | S58-82277 | A | | 5/1983 | |
| JP | 2004-271833 | A | | 9/2004 | |

* cited by examiner

SYSTEM AND METHOD FOR CLEANING AN IMAGE RECEIVING SURFACE IN AN INKJET PRINTER

TECHNICAL FIELD

This disclosure relates generally to systems for cleaning image receiving surfaces in printers, and more particularly, to systems for cleaning image receiving surfaces in printers that treat the image receiving surface with surface preparation materials.

BACKGROUND

Some inkjet printing systems or printers that treat the image receiving surface with surface preparation materials include a cleaning device to remove certain materials from an image surface without removing all of the surface preparation material for the next printing cycle. Surface preparation material is any substance applied to the image receiving surface to enable an ink image to be formed on the surface and to facilitate the transfer of the ink image from the surface to media. Examples of a surface preparation material or a blanket coating include, but are not limited to, a skin coating, a fluid coating, a combination thereof, or the like. In some previously known systems, a blade cleaner is used to remove materials from the image surface. The materials removed from an image surface to replenish the ability of the image surface to form quality images include ink, surface preparation substances, media debris, and the like. Blade cleaners are effective because they can provide higher pressures on the imaging surface, but these pressures can result in a shorter life of the image forming surface and the blade cleaner. Additionally, blade cleaners need a higher blade load required to clean the image surface. The blade cleaners also have a poor reliability because they have a single cleaning edge that slides across a high friction elastomer blanket surface.

In some previously known system, a web cleaner is used to remove materials from the image surface. However, web cleaners have a high consumable cost of web materials and cost of disposal of the webs. While the fiber edges on the web can provide a better redundant cleaning with respect to the blade, the thinness of the web provides little volume for storing the detached ink as it is transported out of the cleaning nip. As such, a web cleaner must be translated through the nip at a rate to transport cleaned ink out of the nip faster than the rate at which the ink enters the nip. Additionally, the web cleaners also have a limited cleaning capacity. The limited ink capacity of webs makes them impractical in high ink density situations.

To address the issues related to blade and web cleaners, some previously known aqueous ink printing systems have used a foam roller that rotates against the movement of the image receiving surface to scruff and carry material away from the surface. In aqueous ink printing systems, the image receiving surface that is cleaned by the foam roller is a blanket of material wrapped around an endless support surface, such as a rotating drum or belt. To enhance the surface properties of the blanket so ink adheres to it during image formation and then releases the ink image during transfer to media, the blanket is treated with a surface preparation material that forms a skin on the blanket surface. This surface preparation material is applied to the surface of the blanket after the ink image has been transferred to media and the blanket surface has been cleaned of the skin and residual ink from the previous imaging cycle. Ideally, the pressure of the foam roller should split and remove the ink layer while only hydrating the skin layer so it can be replenished. If the pressure applied to the blanket by the foam roller is too high, however, the thin skin layer under the ink layer also splits. This splitting of the skin layer enables some of the loosened ink to contact the blanket surface, which has an affinity for the ink. Consequently, the ink adheres to the blanket surface and is harder to remove than ink on the skin preparation material. Thus, the cleaning of the blanket is adversely impacted and image quality can be affected in subsequent imaging cycles.

In certain previously known aqueous ink printing systems, the ink is dried to a semi-wet consistency to enable the transfer of the ink image onto media before the imaging surface is cleaned by the cleaning device. In most cases, the semi-wet ink is easier to clean since the density of the ink is small. However in certain cases, the ink is over-dried. Over-dried ink can occur regularly in machine operation due to machine faults. For example, faults such as media handling faults, control faults and other situations can result in the machine shutting down during the printing operation. The processing of these faults can leave the ink image under the dryers longer than desired. The extra drying can make the dried ink harder to clean. Over drying can also reduce efficiency of the ink image transfer to the media causing a larger amount of the harder-to-clean ink to be introduced to the cleaning device in the printer system. To compensate for the occurrence of these situations, a blade cleaner may be employed since the blade cleaner can apply the higher pressures required to remove dried ink with the attendant risks noted previously.

FIG. 4 is a graph illustrating the effect that drying the aqueous ink on the image forming surface to various degrees has on the cleaning performance. Particularly, the effect of drying the ink on a blanket surface was tested on the load of a blade cleaner. Line 404 in FIG. 4 represents an over-dried ink, line 408 represents a semi-wet ink, line 412 represents undried ink, and line 416 represents water. The vertical axis of the graph in FIG. 4 represents the blade load in g/cm and the horizontal axis of the graph represents the blade working angle in degrees. In previously known aqueous ink printing systems, machine operators resort to isopropyl alcohol soaked rags to remove the over dried ink rather than using water alone. However, as seen in the graph in FIG. 4, the effort required to remove ink rises significantly when over dried ink 404 is cleaned from a blanket by hand. As such, improvements in inkjet printers that enable cleaning of the imaging surface are desirable.

SUMMARY

A printer cleaning device has been configured to enable the removal of material from an image receiving surface of a printer system. The printer cleaning device is included in the printing system that treats the image receiving surface with a surface preparation material. The printer cleaning device includes a roller having a cylindrical wall about an interior volume configured to hold a fluid. The cylindrical wall has a plurality of apertures to enable the fluid within the interior volume to pass through the cylindrical wall. The roller has an opening to enable the interior volume to be fluidly coupled to a source of fluid. The roller is configured to rotate about a longitudinal axis of the cylindrical wall. A foam material is configured to fit about the cylindrical wall and receive the fluid passing through the cylindrical wall. An actuator is operatively connected to the roller to move the roller into and out of engagement with the image receiving surface and a controller is operatively connected to the actuator, the controller being configured to operate the actuator to move the roller into and out of engagement with the image receiving surface to remove material from the surface selectively.

A new method for cleaning an image receiving surface treated with a surface preparation that enables removal of material from the image receiving surface of a printer system. The method includes providing a pump with a fluid to an interior volume within a cylindrical wall of a roller having apertures in the wall to enable the fluid to pass through the cylindrical wall, applying the fluid to the image receiving surface with a foam material mounted about the cylindrical wall, and operating the actuator with a controller to move the roller towards and away from the image receiving surface to enable the foam material to engage and disengage the image receiving surface and selectively remove material from the surface.

BRIEF DESCRIPTION OF THE DRAWINGS

The foregoing aspects and other features of a printer cleaning device that enables the removal of a material are explained in the following description, taken in connection with the accompanying drawings.

DETAILED DESCRIPTION

Figure 1A:
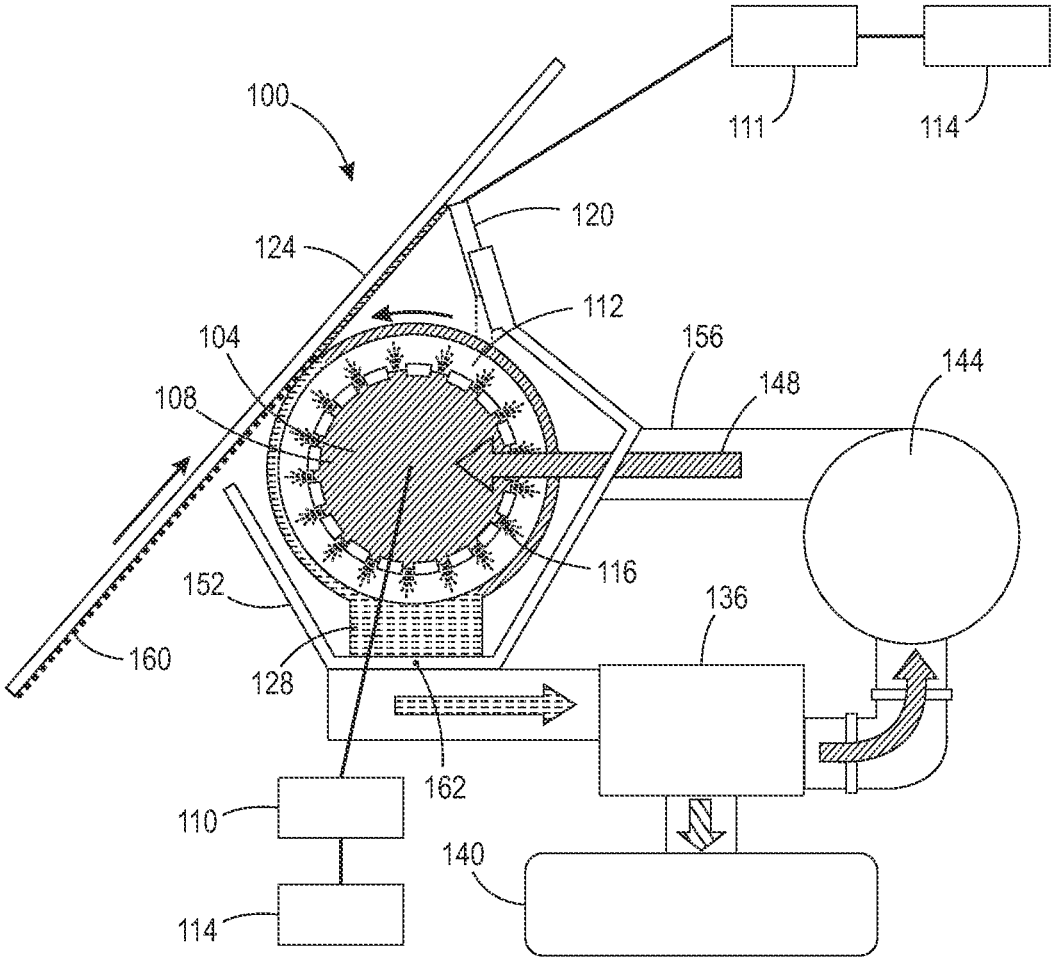
FIG. 1A illustrates an exemplary cleaning device.

For a general understanding of the present embodiments, reference is made to the drawings. In the drawings, like reference numerals have been used throughout to designate like elements.

FIG. 1A illustrates an exemplary cleaning device 100 used in a printer that treats an image receiving surface with a surface preparation material. The printer cleaning device 100 includes a roller 104 having a perforated cylindrical wall 116 that forms an interior volume 108. The interior volume 108 of the roller 104 receives and holds a fluid 148 received from conduit 156. Foam 112 substantially surrounds the cylindrical wall 116 of the roller 104. In one example the foam 112 can be adhesively bonded to the perforated cylindrical wall 116. The fluid 148 within the interior volume 108 is pressurized by pump 144 so the fluid moves through the perforations on the cylindrical wall 116 into the foam 112 and onto the surface of the roller 104.

The surface of the foam 112 of the roller 104 contacts with the image receiving surface of the blanket 124 to apply a portion of the fluid 148 onto the blanket 124 and hydrate materials 160 on the blanket 124. The foam 112 also selectively releases certain materials 160 from the surface of the blanket 124. The surface of the foam 112 contains open cells that function as tiny cleaning blades to release and wipe materials 160 from the surface of the blanket 124. These blades also provide a redundant scrubbing action on the surface of the blanket 124. The redundant scrubbing action by the foam 112 can provide a better reliability and cleaning of the surface of the blanket 124 at lower pressures than other cleaning systems such as a blade cleaner. The open cells in the foam 112 adjacent to the cells in contact with the surface of the blanket 124 also provide capacity to store the released materials 160 from the surface of the blanket 124. The foam 112 has the ability to store a greater amount of materials 160 compared to other cleaning systems such as a web cleaner. The retained materials 160 are flushed from the cells of the foam 112 using the fluid 148. A combination 128 of the materials 160 and fluid 148 flushed from the roller flow off or drip into a housing 152 surrounding the roller 104.

As the blanket 124 continues past the roller 104, a portion of the fluid 148 remains on the blanket 124. After interfacing with the roller 104, the blanket 124 reaches a wiper 120 that applies a blade with sufficient pressure to wipe excess fluid 148 from the surface of the blanket 124. As the wiper 120 wipes the fluid 148 from the surface of the blanket 124, it leaves a relatively dry surface on the blanket 124 before another skin layer is applied to the blanket 124 prior to another imaging cycle. The removed excess fluid flows off onto the roller 104 or into the housing 152.

The housing 152 channels the fluid combination 128 or the removed excess fluid 148 into a collection drain 160 at the bottom of the housing 152. The combination 128 and excess fluid 148 flows through the drain 160 and is transported through a filter 136 to separate the materials 160 from the fluid 148. A pump 144 pumps the filtered fluid 148 back into interior volume 108 of the roller 104. An additional fluid 148 from another source (not shown) can be provided to the interior volume 108 of the roller 104. The separated materials 160 from the filter 136 can be collected for disposal within, for example, the filter 136, a filter media inside the filter 124, a separate container 140, or the like.

In the illustrated embodiment, an actuator 110 is operatively connected to the roller 104 and a controller 114 is operatively connected to the actuator 110 to operate the actuator 110 and rotate the roller 104 in a direction opposite to the motion of the blanket 124. Alternatively, the roller 104 can freely rotate with the blanket so the roller 104 rotates in the direction of movement of the blanket. Another actuator 111 is operatively connected to the wiper 120 and the controller 114 is operatively connected to the actuator 111 to operate the actuator 111 and move the wiper 120 into and out of engagement with the blanket 124.

Materials can be any substance that is carried by the surface of the blanket 112 after the blanket 112 passes through the nip that transfers an image to media. Examples of materials 160 on the surface of the blanket 124 include, but are not limited to, aqueous ink, semi-dried aqueous ink, surface preparation material layers or skin layers, debris, combinations thereof, or the like. Ink can be any substance applied to the image receiving surface to produce an image that is transferred to media. Fluid 116 can be any substance that hydrates a material such as ink or a surface preparation material. Examples of the fluid 148 include, but are not limited to, water, a solvent, a dilate solution of a solvent with water, a dilate solution of a solvent with chemicals such as surfactants, or the like.

In one embodiment, the fluid 148 that is applied to the surface of the blanket 124 reduces the adhesion force of the ink on the surface of the blanket 124. Additionally, the open cell wall edges of the foam 112 apply a tangential force on the surface of the blanket 124 by providing a scrubbing action as the foam 112 slides across the surface of the blanket 124. This force detaches ink from the surface of the blanket 124 and transports the detached ink to the foam 112 and into the volume of the open cell structure of the foam 112. The fluid 148 then flushes the ink from the foam 112.

Figure 4:
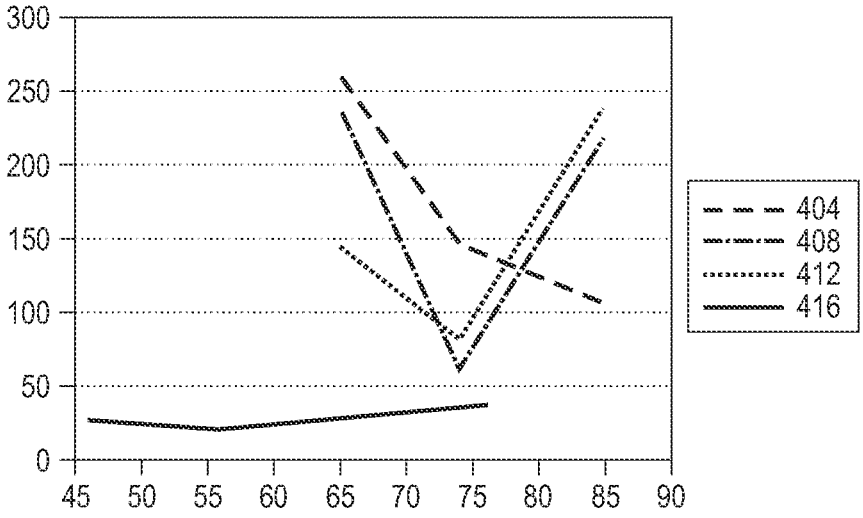
FIG. 4 is a graph illustrating the effect that drying the aqueous ink on the image forming surface to various degrees has on the cleaning performance.

This force that detaches the ink from the surface of the blanket 124 can be increased by certain techniques that include, but are not limited to, increasing the roller 104 interference with the surface of the blanket 124, increasing the density of the pores in the foam 112, increasing the stiffness of the foam 112, increasing the rotational speed of the roller 104, or the like. The capacity of the foam 112 to absorb the detached ink from the surface of the blanket 124 can be modified by certain techniques that include, but are not limited to, changing the density of pores in the foam 112, changing the interference between the foam 112 and the surface of the blanket 124, the thickness of the open cell wall of the foam 112, and the rotational speed of the roller 104. The rotational speed of the roller 104 can also determine the effective cleaning nip against the surface of the blanket 124. Certain chemicals such as surfactants added to the fluid 148 can also reduce the adhesion of ink or other materials 160 with the surface of the blanket 124. These chemicals that reduce the adhesion of ink may also improve the ability to flush the ink from the foam 112. Other factors that influence the ability to flush ink from the foam 112 include, but are not limited to, the chemistry of the fluid 148 used, the flow rate of the fluid 148 through the foam 112, the adhesion of the ink to the foam 112. The adhesion of ink to the foam 112 depends on factors such as the chemistry of the ink and the foam 112. In one example, foam 112 is a hydrophobic foam because aqueous ink has a higher adhesion to hydrophilic foam than it does to hydrophobic foam. Consequently, aqueous ink is more easily removed from hydrophobic foam than from hydrophilic foam. Example 1 below and FIG. 4 depict data supporting this conclusion. Additionally, the surface area of the foam 112 can also influence the amount of fluid 148 retained in the foam 112. For example, the material of the foam 112 can be chemically inert to the fluid 148 and the materials 160 so that the materials 160, such as ink and skin, are easily flushed out of the foam 112. If the materials 160 can be easily rinsed out of the foam 112, a slower build-up of the materials 160 occurs over time and this attribute can extend the life of the roller 104.

Additionally, in one embodiment, the material of the foam 112 should be able to sufficiently retain the fluid 148. For example, if fluid 148 flows out of the foam 112 too easily, then the fluid 148 may run out of the bottom of the roller 104 and not provide adequate hydration to the surface of the blanket 124. If the fluid 148 is poorly retained in the foam 112, an excessive spray of the fluid 148 may occur at high rotational speeds of the roller 104. Certain foam materials can be used for the roller 104 that appropriately retain the fluid 148. For example, a foam with a high pore density may retain the fluid 148 better than a foam with a lower pore density.

The strength of the foam 112 may assist the roller 104 to avoid tearing and extend the life of the roller 104. Examples of foam materials that can be used include, but are not limited to, polyurethanes, which can have a good strength and wear resistance, or the like. The friction coefficient between the foam 112 and the material 160 or the surface of the blanket 124 may also affect the life of the roller 104. For example, a foam with a lower friction coefficient encounters less stress so the life of the roller 104 is extended. The amount of torque required to drive the roller 104 and the steering forces on the surface of the blanket 124 are also lower for foam having a lower friction coefficient. A lower torque reduces the strength requirements for the adhesive used to bind the foam 112 to the perforated cylindrical wall 116. Materials such as silicone foams can provide a lower friction coefficient than materials such as urethane foams, however, the silicone foams are usually made with closed cells.

The compression stiffness of the foam 112 can also influence the effectiveness of the roller 104. The cleaning load is generated by compressing the foam 112 on the roller 104 against the surface of the blanket 124 to form a cleaning nip. Stiffer foam generates the load required to clean the blanket with a narrower nip width than a softer foam. Factors that affect the compression stiffness of the foam 112 include, but are not limited to, the modulus of the foam material, the density of the pores in the foam, the thickness of the cell walls of the foam, or the like. When the foam 112 is saturated with the fluid 148, any compression of the foam 112 expels the fluid 148 from the foam 112. In one example, as the roller 104 enters the cleaning nip, the fluid 148 is expelled as the foam 112 is being compressed. As the roller 104 leaves the cleaning nip, the foam 112 expands and attempts to draw in fluid to fill the voids with the cells of the foam 112. The fluid 148 is pumped from within the interior volume 108 through the foam 112 to prevent the materials 160 from being drawn into the roller 104. A larger cleaning nip compresses a larger volume of the foam 112 and requires more flow of the fluid 148 through the roller 104. As such, to minimize the volume of wasted fluid 148 that is filtered, the width of the cleaning nip may be minimized while still maintaining a good cleaning. A stiffer foam 112 assists in minimizing the filtration needs of the system.

The resistance of the flow of the fluid 148 through the perforated cylindrical wall 116 and into the foam 112 can also influence the effectiveness of the roller 104. Factors that can influence the flow resistance of the fluid 148 through the roller 104 include, but are not limited to, thickness of the foam 112, the size of the perforation holes in the cylindrical wall 116, the spacing of the perforation holes in the cylindrical wall 116, the density of the pores in the foam 112, the internal structure of pores in the foam 112 (for example the thickness and surface area of the pores), or the like. In one example, a uniform distribution of the fluid 148 flowing from the perforations in the cylindrical wall 116 can provide an efficient roller 104. For example, if the spacing of the perforation holes in the cylindrical wall 116 is too small, then the cylindrical wall 116 may have insufficient area to reliably bond the foam 112 to the cylindrical wall 116. Too many perforation holes in the cylindrical wall 116 can enable the cylindrical wall 116 to become weaker and the cylindrical wall 116 may fracture if it bends as the roller 104 loads against the surface of the blanket 124. However, if the flow resistance of the foam 112 is too low, then a uniform flow of the fluid 148 through the perforations in the cylindrical wall 116 may be difficult to achieve because the fluid 148 can easily flow out of the perforations holes without much spreading. If the flow resistance of the foam 112 is too high, then excessive pressure may be required to achieve the desired rate of flow of the fluid 148 through the roller 104. A higher flow resistance of the foam 112 can also place additional stress across the thickness of the foam 112 that could lead to a failure of the foam 112 bonding with the cylindrical wall 116 or a tearing of the foam. In another example, the flow of the fluid 148 in the roller 104 is relatively high at very low pressures. The reader should understand that other techniques can be used to design the system 100 in order to provide the desired fluid 148 and the flow to the roller 104.

The dimensional stability of the foam 112 in the roller 104 can also influence the effectiveness of the roller 104. For example, certain foams 112 swell to different extents with different fluids 148. Foams, such as Capu-Cell, can significantly swell when saturated with water. When such a foam dries, it returns to its original size. As such, in one example, the roller 104 is designed by taking the amount of swelling into account. The reader should understand that the amount of swelling may change over time. For example, as the foam 112 in the roller 104 accumulates materials 160, such as ink and skin, the swelling characteristic of the foam 112 may change. With enough accumulated materials 160, the foam 112 in the roller 104 may not return to its original shape when the foam 112 dries. Accumulation of the materials 160 in the foam may also increase the stiffness of the foam 112.

Examples of the wiper 120 include, but are not limited to, an elastomer squeegee blade, a polyurethane blade such as Synztec 238707 70 Shore A durometer, xerographic blade, a urethane blade, a higher durometer polyurethane blade, a urethane blade, other elastomers or polymers that have a lower friction against the blanket 124, or the like. In one example, the wiper 120 can be mounted to a housing that operates the wiper 120 with interference loading or the wiper 120 can be mounted on a pivoting holder with a force loading against the blanket 124. Since the wiper 120 is wiping excess fluid 148 from the blanket 124, the load of the wiper 120 against the blanket 124 can be lower relative to a load required to clean materials 160 such as ink.

In one embodiment, the filter 136 can provide micro-filtration, ultra-filtration, nano-filtration, reverse osmosis, combinations thereof, or the like to separate the materials from the combination 128 of fluid 148 and materials 160. The filter 136 can include a porous filter media having very small pore sizes to separate the materials from the combination 128. In one example, different filter medias of varying pore sizes can be used to filter different materials from the combination 128. For example, the filter 136 includes very small pore sizes such as a pore size of about less than 0.01 μm. The filter 136 also includes a skin filter having a pore size of about less than 10 μm. For example, a 1 μm filter allows some smaller skin components to pass through and clogs relatively quickly with the larger components that are filtered. A larger pore size may be required to filter the skin because the components of the skin are larger and can clog the pores required to filter ink. In another example, a series of progressively smaller pore size filters are positioned inside the filter 136 to efficiently separate different materials from the combination 128. The reader should understand that these parameters are exemplary and other pore sizes or filter materials can be used to separate the materials from the combination 128. In one example, the pump 144 can be operated in reverse to pull filtered fluid from the interior volume 108 of the roller 104 and through the filter 136 to back-flush the filter and remove filtered materials from the filter media to enable reuse of the filter media. Alternatively, the filter can be back-flushed with other techniques that include, but are not limited to, using a machine, an external reclamation process, or removing and washing the filter media.

While a roller 104 is described herein, the reader should understand that other components can be used. Examples of these components include, but are not limited to, a foam pad, a sprayer, or the like to enable the fluid 148 to be dripped, sprayed, or dipped onto the surface of the blanket 124. While the foam 112 is described herein, the reader should understand that other materials 112 can be used to scrub the surface of the blanket 124 and store the removed materials 160 from the surface of the blanket 124. While a wiper 120 is described, the reader should understand that other components can be used to wipe or dry excess fluid 148 from the surface of the blanket 124.

Figure 1B:
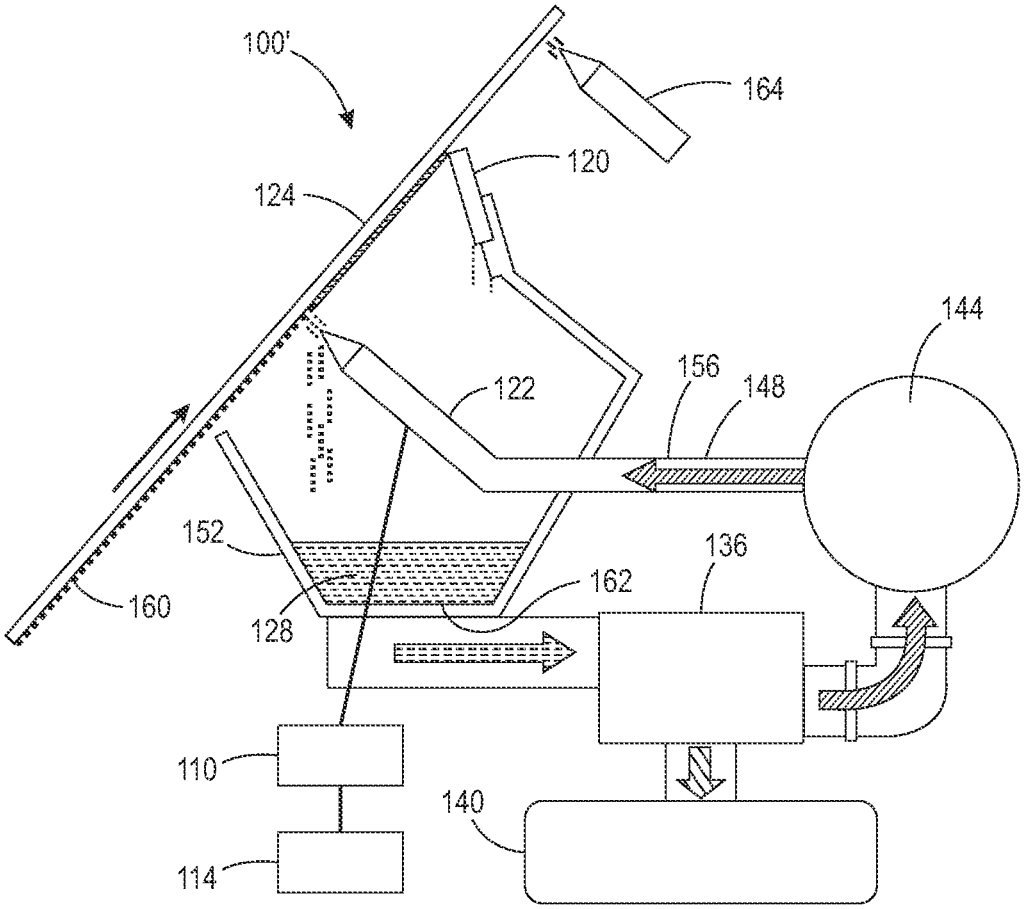
FIG. 1B illustrates an alternative embodiment of the cleaning device shown in FIG. 1B.

FIG. 1B illustrates an alternative embodiment 100' of the cleaning device used in a printer that forms images with aqueous ink. The printer cleaning device 100' includes a sprayer 122 that sits within a receptacle 152 to catch fluid 128 that may drip from the blanket 124. The fluid 128 can be provided back to the filter 136 for filtering. The sprayer 122 sprays fluid 148 onto the blanket 124 to hydrate the materials 160 on the surface of the blanket 112. The pressure of the sprayed fluid is sufficient to hydrate the materials on the surface of the blanket 124 and to remove certain materials 160 from the blanket 124. A combination 128 of materials 160 and fluid 148 flows off or drips into a housing 152. In the illustrated embodiment, an actuator 110 is operatively connected to the sprayer 122 and a controller 114 is operatively connected to the actuator 110 to operate the sprayer. A wiper 120 contacts the surface of the blanket 124 as noted above to remove the fluid 148 from the blanket 124 that drips into the housing 152. After the blanket 124 passes through the wiper 120, components 164 such as an air knife, heated driers, or the like can be used to additionally dry the surface of the blanket 124. The drain 162 at the bottom of the housing 152 diverts the removed combination 128 to a filter 136 to separate the ink and surface preparation material from the fluid 148. A pump 120 forces the filtered fluid 148 back to the sprayer 122.

Figure 2:
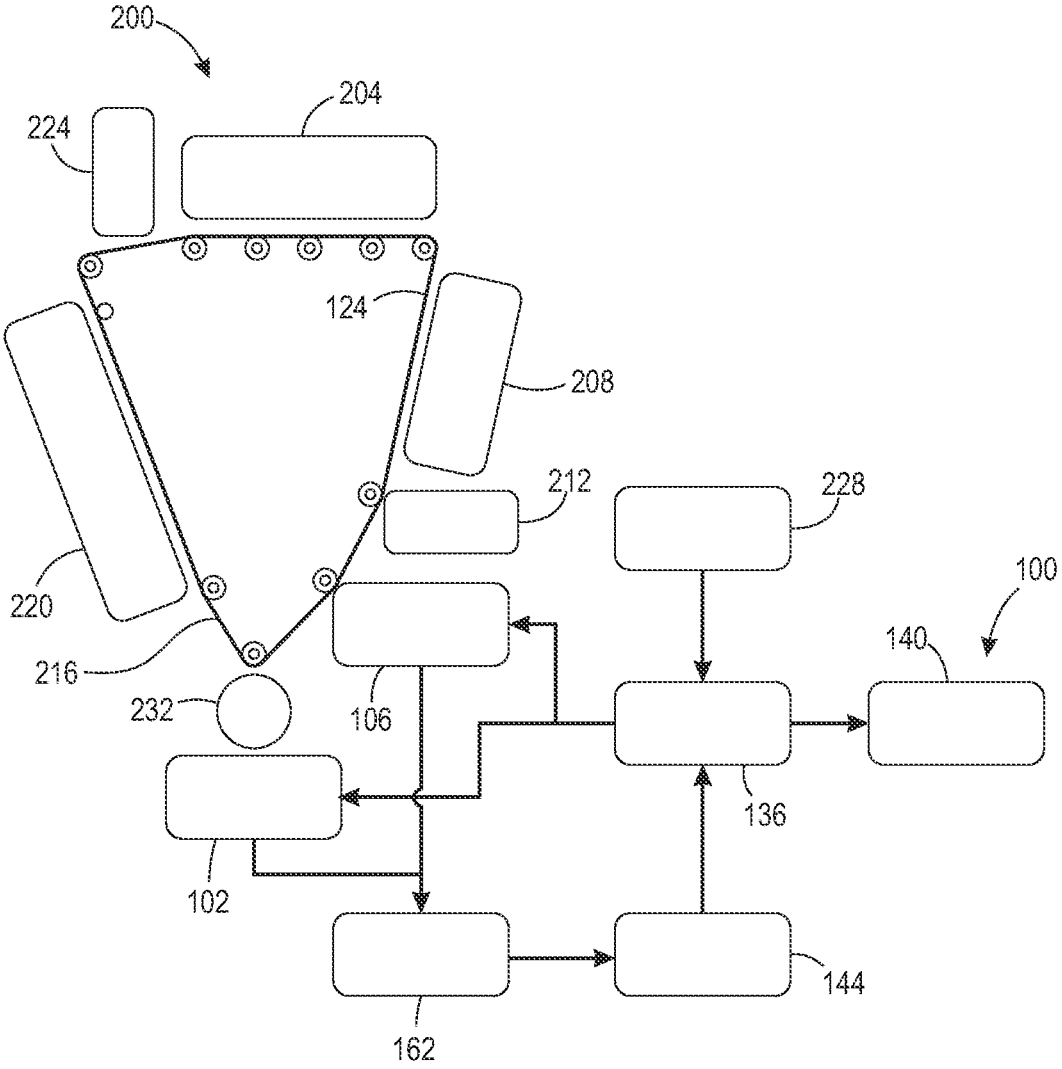
FIG. 2 illustrates an exemplary printer system in which the cleaning device of FIG. 1A is used.

FIG. 2 illustrates an exemplary printer system 200 in which the cleaning device 100 is used. A coater 212 applies a layer of surface preparation material that forms a skin on the surface of the blanket 124. The blanket 124 and the applied material are dried to a certain degree using a dryer 208. Dryer 208 can be implemented with, but not limited to, an air knife, a heated dryer that directs air or heat onto the blanket 124, combinations thereof, or the like. The blanket 124 passes through an imager 204 that deposits ink onto the surface of the blanket 124 to form an ink image. Another dryer 220 is used to dry the ink image to a certain degree. The partially dried ink image 216 then enters a nip formed by the blanket 124 and the transfer roller 232 to transfer the ink to media synchronized to pass through the nip as the ink image passes through the nip. The blanket 124 then passes through a portion 106 of the cleaning device 100, which is similar to the foam, housing and wiper of the cleaner 100 described above. The foam deposits fluid onto the image receiving surface and removes a portion of the fluid and ink from the image receiving device and a wiper removes the fluid from the blanket as described above. The diverted fluid and material 128 are collected in a drain 162 at the bottom of the housing 152 and a pump 144 pulls the removed fluid and material from the drain 162 and urges it through a filter 136 to remove the ink and skin material, which is sent to waste collector 140. The filtered fluid is returned to the receptacle of the cleaning portion 106. The filter 136 also receives clean fluid 148 from fluid source 228 to back-flush the separated materials from the filter and direct them into waste container 140. Transfer roller maintenance system 102 applies cleaning fluid to transfer roller 232 and removes residual material from the roller that is collected in drain 162 to be filtered with the fluid and material collected from the cleaning portion 106.

Figure 3:
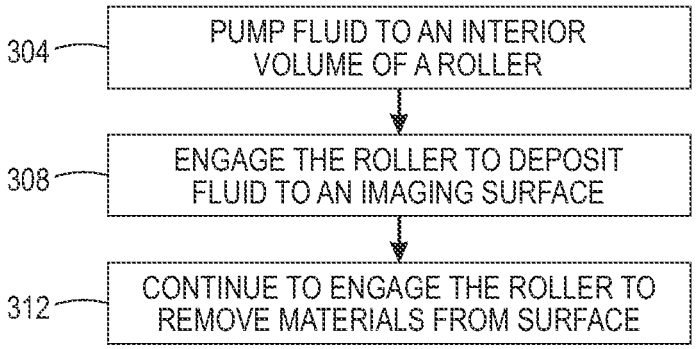
FIG. 3 illustrates an exemplary process of using a cleaning device.

FIG. 3 illustrates an exemplary process of using the cleaning device 100. Fluid 148 is pumped into an interior volume 108 of a roller 104 (Step 304). A controller 114 operates an actuator 110 to engage a surface of the blanket 124 with the roller 104 to deposit a portion of the fluid 148 onto the blanket 124 (Step 308). The roller 104 continues to rotate against surface of the blanket 124 to enable the deposited fluid 148 to hydrate materials on the surface of the blanket 124 and to remove certain materials 160 from the surface of the blanket 124 (Step 312). Additionally, a wiper 108 can be possibly used to remove any excess fluid 116 from the surface of the blanket 124. The removed combination 128 of fluid 148 and materials 160 are collected and diverted into a drain 162 at the bottom of a housing 152. The removed combination 128 is transported through a filter 136. The filter 136 separates the fluid 148 from the materials 160. The filtered fluid 148 is then provided back to the roller 104 for reuse using a pump 144. The separated materials are then removed for disposal into a waste disposal 140.

EXAMPLES

The following example of the printer cleaning device 100 is to be considered illustrative in nature, and is not limiting in any way.

Example 1

Figure 5:
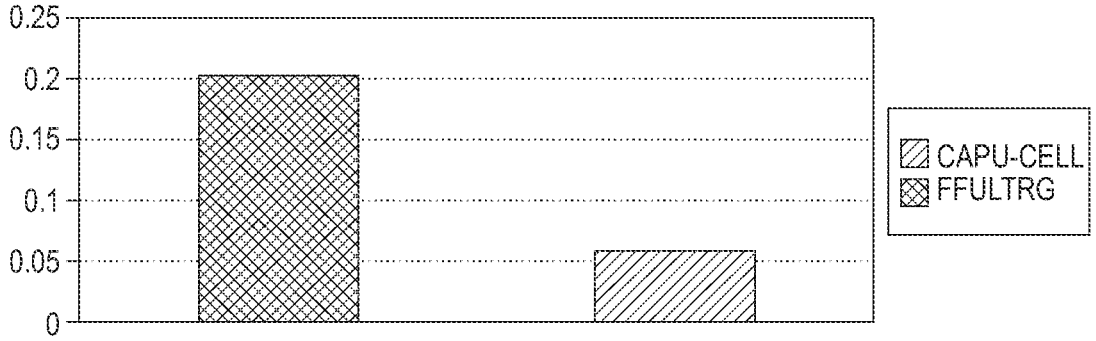
FIG. 5 illustrates an exemplary plot of the load to clean the blanket using different foams.

FIG. 5 illustrates an exemplary plot of the load that is needed to clean the blanket using Ultra-Fine (FFULRG) foam and a Capu-Cell hydrophilic foam. In this example, an exemplary system 100 described herein was used with Ultra-Fine (FFULRG) foam and the Capu-Cell hydrophilic foam. The ink on the surface of the blanket was dried for 2 minutes at 70 degrees Celsius to a semi-wet condition. The x-axis of the plot represents the foam type and the y-axis of the plot represents the load needed to clean the surface of the blanket in g/mm$^2$. As illustrated in FIG. 5, the load needed to clean the blanket is higher for the Ultra-Fine (FFULRG) foam and Capu-Cell hydrophilic foam. Since the pore densities of the two foams are similar, the difference in cleaning load can be attributed to a higher adhesion of ink using the hydrophilic Capu-Cell foam than the Ultra-Fine (FFULRG) foam.

Example 2

Figure 6:
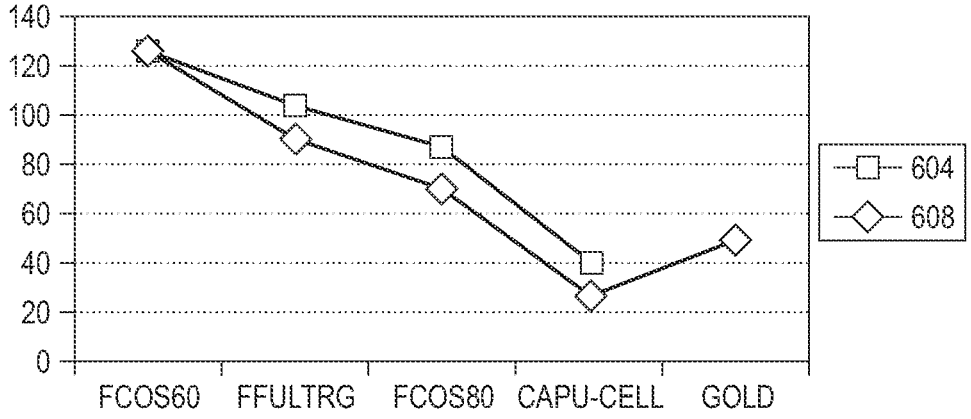
FIG. 6 illustrates another exemplary plot of the load to clean a blanket using different foams.

FIG. 6 illustrates another exemplary plot of the load to clean a blanket using different foams. In this example, an exemplary system 100 described herein was used with a FCOS60 foam, a FFULTRG foam, a FCOS80 foam, a Capu-Cell foam, and a Gold foam. These foams were tested with ink that was dried for 60 minutes at 70 degree Celsius to an over-dried condition (line 604) and ink that was dried for 2 minutes at 70 degree Celsius to a semi-wet condition for 2 minutes at 70 degree Celsius (line 608). The x-axis of the plot represents the foam type and the y-axis of the plot represents the load needed to clean the surface of the blanket in g/cm. As illustrated in FIG. 6, the different foams provide different loads needed to clean the ink from the surface of the blanket. As also illustrated in FIG. 6, over-drying the ink makes it harder to clean the ink by increasing the load needed to clean the ink from the surface of the blanket.

Example 3

Figure 7:
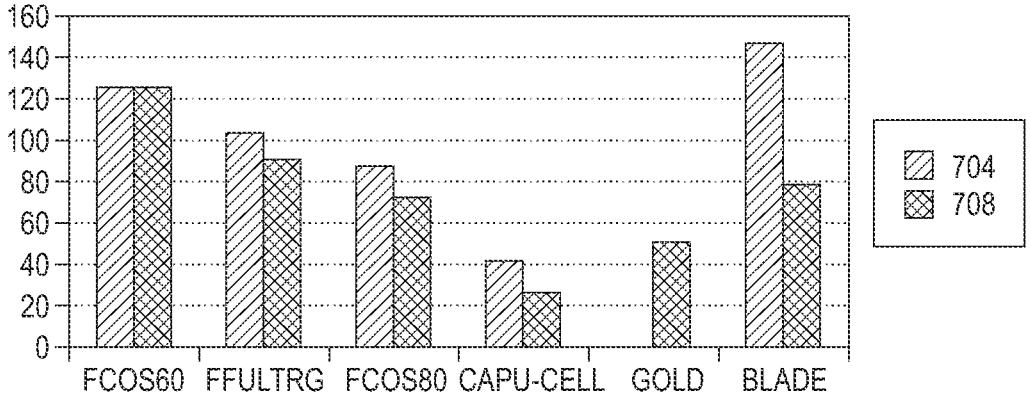
FIG. 7 illustrates another exemplary plot of the load to clean a blanket using different foams and a wiper blade.

FIG. 7 illustrates another exemplary plot of the load to clean a blanket using different foams and a wiper blade. In this example, an exemplary system 100 described herein was used with a urethane cleaning blade, a FCOS70 foam, a FFULTRG foam, a FCOS80 foam, a Capu-Cell foam, and a Gold foam. These foams and blade were tested with ink that was dried for 60 minutes at 70 degree Celsius to an over-dried condition (line 704) and ink that was dried for 2 minutes at 70 degree Celsius to a semi-wet condition (line 708). The x-axis of the plot represents the foam type and the y-axis of the plot represents the load needed to clean the surface of the blanket in g/cm. As illustrated in FIG. 5, for ink that has been dried to a semi-wet condition (i.e. 2 minutes at 70 degree Celsius), the blade requires a load of about 75 g/cm. The Gold and Capu-Cell foams, which have a pore density greater than about 100 ppi (pores/inch), require a significantly less load to clean. The FCOS70 foam requires a much higher load to clean due to its low pore density, which can be about 70 ppi. The FCOS80 foam has a slightly lower load to clean than the blade and a much lower load than the FCOS70 foam due to its higher pore density, which can be about 80 ppi. The FFULTRG foam, which has a pore density greater than about 100 ppi, has a higher cleaning load than the blade.

Example 4

Figure 8:
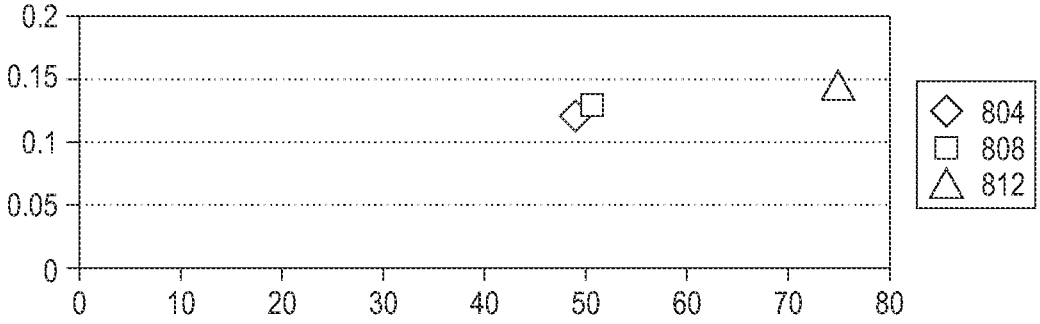
FIG. 8 illustrates an exemplary plot illustrating widths of the nip in an exemplary system.

FIG. 8 illustrates an exemplary plot illustrating the width of the nip in an exemplary system 100. In this example, an exemplary system 100 described herein was used with a Gold foam using different width of the nip. This foam was tested with nip widths of 46 mm (line 804), a nip width of 38 mm (line 808), and a nip width of 22 mm (line 812). The x-axis of the plot represents the load needed to clean the surface of the blanket in g/mm2 and the y-axis of the plot represents the load needed to clean the surface of the blanket in g/cm. Flat foam pads were used as the nip widths. These flat foam pads were equivalent to a fixed nip roller operating at different rotational speeds. As illustrated in FIG. 8, higher cleaning loads are required to clean at the lowest nip width, 22 mm (line 812). The two higher nip widths of 46 mm and 38 mm have similar cleaning loads. As further illustrated in FIG. 8, when the nip width becomes large enough, little benefit arises from cleaning load reduction due to further nip width increases. This correlation can be due to the ink holding capacity of the foam. A short nip fills with ink and allows some to pass through the nip. In order to clean with a short nip, the load can be increased to force ink further into the foam pores and to increase the effective pore density by increased compression of the foam against the blanket. A longer nip width provides greater ink holding capacity at lower foam compression, i.e., load. Another way to increase the effective pore density and nip width can be by rotating the roller at a higher speed against the direction of motion of the blanket. The higher speed increases the number of pores a spot on the blanket experiences as it moves through the roller nip and increases the rate at which ink is taken out of the nip.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A printer cleaning device included in a printing system that treats an image receiving surface with a surface preparation material, the cleaning device comprising:

a roller having a cylindrical wall about an interior volume configured to hold a fluid, the cylindrical wall having a plurality of apertures to enable the fluid within the interior volume to pass through the cylindrical wall, the roller being configured with an opening to enable the interior volume of the roller to be fluidly coupled to a source of fluid and the roller being configured to rotate about a longitudinal axis of the cylindrical wall;

a foam material having an inner surface that is configured to fit about and directly contact the cylindrical wall of the roller and directly receive the fluid passing through the cylindrical wall of the roller from the interior volume of the roller;

an actuator operatively connected to the roller to move an outer surface of the foam material fitted about the cylindrical wall of the roller into and out of direct engagement with the image receiving surface within the printer system; and a controller operatively connected to the actuator, the controller configured to operate the actuator to move the outer surface of the foam material fitted about the cylindrical wall of the roller into and out of direct engagement with the image receiving surface to enable the foam material and the fluid in the foam material to remove selectively material from the surface of the printer system.

2. The printer cleaning device of claim 1, further comprising:

a pump configured to provide fluid through the opening in the roller to the interior volume of the roller.

3. The printer cleaning device of claim 2, the controller being further configured:

to operate the actuator to compress the foam between the cylindrical wall of the roller and the image receiving surface to release a portion of the fluid from the foam material onto the image receiving surface; and to operate the actuator to move the roller away from the image receiving surface to disengage the foam from the image receiving surface to enable the foam material to expand and absorb fluid and material from the image receiving surface.

4. The printer cleaning device of claim 3, the pump being further configured:

to provide the fluid at a pressure that enables fluid passing through the cylindrical wall of the roller to flush a portion of the absorbed fluid and material from the foam material.

5. The printer cleaning device of claim 3, further comprising:

a receptacle positioned to receive flushed fluid and material from the foam material; and a filter positioned within the receptacle to separate fluid from material.

6. The printer cleaning device of claim 5, wherein the pump is fluidly connected to the receptacle to enable the pump to pull filtered fluid from the receptacle and provide the filtered fluid to the interior volume of the roller.

7. The printer cleaning device of claim 5, wherein the foam material consists essentially of a hydrophobic foam.

8. The printer cleaning device of claim 5, wherein pores in the filter are essentially less than 0.01 μm in diameter.

9. The printer cleaning device of claim 5, wherein the filter is further configured to provide at least one of microfiltration, ultra-filtration, nano-filtration, and reverse osmosis to separate fluid from material.

10. The printer cleaning device of claim 5, further comprising:

another receptacle; and the pump is further configured to reverse direction of the fluid being pumped to back-flush the filter and direct material from the filter into the other receptacle.

11. The printer cleaning device of claim 5, the filter being further configured for removal from the receptacle for cleaning or replacement.

12. The printer cleaning device of claim 1, the actuator being further configured to rotate the roller about the longitudinal axis in a direction that is opposite a direction of movement for the image receiving surface; and the controller being further configured to operate the actuator and rotate the roller against the direction of movement for the image receiving surface while the foam material engages the image receiving surface.

13. The printer cleaning device of claim 1, wherein the fluid comprises water or a combination of water and a cleaning solution.

14. The printer cleaning device of claim 1 further comprising:

a wiper configured to remove fluid and material from the image receiving surface after the image receiving surface has passed the roller; and another actuator operatively connected to the wiper to move the wiper into and out of engagement with the image receiving surface.

15. The printer cleaning device of claim 14, wherein the wiper blade consists essentially of at least one of polyurethane, elastomers, and polymers.

16. The printer cleaning device of claim 1 further comprising:

an air knife or a heated dryer positioned to direct air or heat, respectively, towards the image receiving surface to remove fluid from the image receiving surface after the image receiving surface has passed the roller.

* * * * *